US005810263A

United States Patent [19]

Tramm

[11] Patent Number: 5,810,263

[45] Date of Patent: Sep. 22, 1998

[54] DEFLECTOR FOR HORIZONTAL-TYPE FIRE SPRINKLERS

[75] Inventor: Robert D. Tramm, Warwick, R.I.

[73] Assignee: Grinnell Corporation, Cranston, R.I.

[21] Appl. No.: 695,391

[22] Filed: Aug. 12, 1996

[51] Int. Cl.[6] ..... A62C 37/04

[52] U.S. Cl. ..... 239/518; 169/38

[58] Field of Search ..... 239/512, 518, 239/520, 521; 169/37, 38

[56] References Cited

U.S. PATENT DOCUMENTS

| | | | |
|---|---|---|---|
| Re. 24,353 | 9/1957 | Kromer | 239/521 X |
| 783,826 | 2/1905 | Dinkel | 239/521 X |
| 2,046,169 | 6/1936 | Knight | 169/37 X |
| 2,101,694 | 12/1937 | Tyden | 169/37 |
| 2,862,565 | 12/1958 | Dukes | 169/38 |
| 3,880,239 | 4/1975 | Vorkapich | 239/524 X |
| 4,074,862 | 2/1978 | Jardinier et al. | 239/524 X |
| 4,296,815 | 10/1981 | Mears | 169/37 |
| 4,296,816 | 10/1981 | Fischer | 169/37 |
| 4,580,729 | 4/1986 | Pounder | 239/524 |
| 4,987,957 | 1/1991 | Galaszewski | 169/37 |
| 5,180,103 | 1/1993 | Harrison, Jr. et al. . | |

FOREIGN PATENT DOCUMENTS

| | | | |
|---|---|---|---|
| 2542559 | 3/1977 | Germany | 239/521 |
| 1307095 | 2/1973 | United Kingdom . | |
| 2103481 | 2/1983 | United Kingdom . | |
| 2163953 | 3/1986 | United Kingdom . | |
| 2206043 | 12/1988 | United Kingdom . | |

OTHER PUBLICATIONS

"Flush Horizontal Sidewall Sprinklers"; Grinnell Corporation; Technical Data Sheet TD538; dated Jul. 1995.

"Hor. Sidewall & Recessed Hor. Sidewall Sprinklers"; Grinnell Corporation; Technical Data Sheet TD545; dated Apr. 1994.

"Sprinklers, Nozzles and Accessories/Section 4"; Grinnell Corporation; Model F950 Q34; Catalog Bulletin No. 219; dated Aug., 1975.

"Automatic Sprinklers, Model F950 Duraspeed"; Grinnell Corporation; Technical Data Sheet 5 AS/17; dated Jan. 31, 1979.

"Horizontal Sidewall Sprinkler"; Grinnell Corporation; Technical Data Sheet TD536; dated Sep. 1987.

'Automatic' Quick Resonse Horizontal Sidewall Glass Bulb Sprinklers; ASCOA Fire Systems Catalog Sheet 3.19; dated Nov. 1989.

"'Automatic' Horizontal Sidewall Sprinklers"; Automatic Sprinkler Corporation of America; Model F Horizontal Sidewall Sprinkler; Catalog Sheet 2.17; dated Jul. 1981.

Viking Model M Extended Coverage Horizontal Sidewall Sprinkler; Catalog Sheet Sprinkler 82a; dated Mar. 26, 1996.

*Primary Examiner*—Kevin Weldon

*Attorney, Agent, or Firm*—Fish & Richardson P.C.

[57] ABSTRACT

A horizontal-type fire protection sprinkler has a body defining an orifice and outlet for flow of fluid from a source, and a deflector disposed generally along an axis of the orifice and positioned for impingement of the flow of fluid from the outlet thereupon. The deflector has a generally vertical portion and a generally horizontal flow confining element. A substantial portion of the generally horizontal flow confining element is disposed relatively closer to the orifice than the generally vertical portion.

28 Claims, 3 Drawing Sheets

DEFLECTOR FOR HORIZONTAL-TYPE FIRE SPRINKLERS

This invention relates to fire protection sprinklers the horizontal-type.

BACKGROUND OF THE INVENTION

Horizontal-type fire protection sprinklers may be operated individually, e.g. by a self-contained thermally sensitive element, or as part of a deluge system in which fire retardant fluid flows through a number of open sprinklers, essentially simultaneously.

Fire sprinklers have a body with an outlet, and an inlet which is connectable to a source of fire retardant fluid under pressure. Individual fire sprinklers may be automatically or non-automatically operating. In the case of automatically operating fire sprinklers, the outlet is secured in the normally closed or sealed position by a cap, the cap being held in place by a thermally-sensitive element released when its temperature is elevated to within a prescribed range, e.g. by the heat from a fire. The outlets of non-automatic sprinklers are maintained normally open and such sprinklers are operated in an array, as part of a deluge system, from which fire retardant fluid is flowed when an automatic fluid control valve is activated by a separate fire, i.e. heat, detection system.

Installation or mounting position is another parameter which distinguishes different types of fire sprinklers. For example: Pounder U.S. Pat. No. 4,580,729 illustrates a pendent mounting sprinkler arranged so that the fluid stream discharged from the outlet is directed initially downwards against the deflector; Dukes U.S. Pat. No. 2,862,565 illustrates an upright mounting sprinkler arranged so that the fluid stream discharged from the outlet is directed initially upwards against the deflector; and Mears U.S. Pat. No. 4,296,815 and Fischer U.S. Pat. No. 4,296,816 illustrate a horizontal mounting (horizontal-type) sprinkler arranged so that the fluid stream discharged from the outlet is directed initially horizontally against the deflector. In each case, the purpose of the deflector is to break up the fluid stream into a pattern of spray that can suitably cover the area to be protected by the sprinkler from fire.

Horizontal-type fire sprinklers are primarily designed for installation along a wall or along the side of a beam, just beneath a ceiling. Installed with the outlet centerline horizontal, this type of sprinkler produces a generally quarter-spherical fluid spray pattern that is directed predominantly downward and outward from the deflector. However, a portion of the spray is also directed towards the rear of the sprinkler, i.e. against the mounting wall or beam.

In order to be acceptable for use under an installation standard like NFPA 13, Installation of Sprinkler Systems, fire sprinklers must appear in a list published by an organization acceptable to the local governmental authority having jurisdiction, and meet any additional requirements specified in the installation standard. Organizations which list horizontal-type sprinklers include, for example, Underwriters Laboratories Inc. (UL) and Factory Mutual Research Corporation (FM), which have fire protection product evaluation laboratories in the United States, as well as, the Loss Prevention Council Certification Board (LPCB) which has product evaluation laboratories in the United Kingdom. Although the acceptance criteria and test methods may vary, each of these organizations evaluates the performance of fire protection products, like horizontal-type sprinklers, against established standards or guidelines, to certify that the listed fire protection products will satisfactorily perform their intended function when installed in accordance with the requirements of their listing, the manufacturer's installation instructions, and the installation standards of the authority having jurisdiction.

The standards or guidelines used by each listing organization for evaluating horizontal-type sprinklers include, as a minimum, established requirements for: minimum amount of water which must be collected, per unit time, in specified areas (i.e., density) under and between the sprinklers, when they are discharging fluid under specified flowing (residual pressure) conditions; and strength of the deflector. In addition, both UL and FM require that horizontal-type sprinklers also be evaluated with respect to the amount of water sprayed to the rear of the sprinkler, i.e., for the purpose of wetting a wall or beam against which the sprinkler is mounted or, which is located just behind the sprinkler. However, the LPCB has a particularly stringent deflector strength requirement involving application of a vertical load to the deflector at its weakest location. This requirement is not readily met by the material properties and structural design of horizontal-type sprinkler deflectors usually capable of meeting UL and FM evaluation requirements.

Horizontal-type sprinklers are considered to be a special purpose sprinkler. They were originally developed for use in locations such as executive offices, hotel lobbies, and dining rooms, where the installation of standard sprinklers with normal spacings may be considered objectionable because of appearance. Although aesthetics remains an important parameter in the selection of horizontal-type sprinklers, for use in a particular installation, they are now also used in lieu of pendent and upright sprinklers because of building construction or installation economic considerations.

Deflectors of horizontal-type sprinklers may be either attached to the apex of generally U-shaped, exposed frame arms which, in turn, are fixed to the sprinkler body, e.g. as illustrated in the Mears and Fischer patents mentioned above; or attached to pins which slidably mount within the sprinkler body, as described by Grinnell Corporation of Exeter, New Hampshire in Technical Data Sheet TD538 (dated 07/95).

The sidewall mounting, horizontal-type of sprinkler illustrated in TD538 has a lower exposed profile than that described in the Mears and Fischer patents, as well as in Galaszewski U.S. Pat. No. 4,987,957; however, the added complexity of this so-called flush-type design makes it significantly more costly. When found acceptable by the listing organization, horizontal-type sprinklers with exposed frame arms may also be installed within a recessed escutcheon, e.g. as illustrated in Grinnell Corporation Technical Data Sheet TD545 (dated 04/94). At a slight increase in cost, the use of a recessed escutcheon with a horizontal-type sprinkler having exposed frame arms makes it become more appearance competitive with the flush-type design; however, the flush-type design still retains its premium appearance standing in the market.

Within the present state of the art, deflectors for horizontal-type sprinklers usually include a flow confining element, such as indicated by reference numeral 62 in Mears U.S. Pat. no. 4,296,815 or by reference numeral 11 in Galaszewski U.S. Pat. No. 4,987,957. A rare exception to this arrangement was seen in Grinnell Corporation's Model F950 Q34 horizontal extended coverage horizontal sidewall sprinkler, as described in Grinnell Corporation catalog Bulletin No. 219 (dated August, 1975). However, this sprinkler was only in production for a limited time before it was replaced by Model F950 Q-45 extended coverage horizontal sidewall sprinkler, with flow confining element, as described in Grinnell Corporation Technical Data Sheet Sec. 5 AS/17 (dated 01/31/79). The F950 Q34 sprinkler was designed for usage at a ceiling-to-deflector distance of up to about 36 inches, and the spray discharged by the F950 Q34 had a relatively high upward trajectory. This caused an excessive amount of spray to strike the ceiling, and prevented the desired extension of spray from the sprinkler when installed at a ceiling-to-deflector distance of as little as 4 inches, e.g. as required for hotel room applications and the like.

The Mears and Galaszewski patents depict flow confining elements for which the majority of their lower surface, which confines the upward movement of fluid flow, is horizontal or parallel to the axis of the sprinkler orifice through its center. However, other designs may have flow confining elements substantially parallel to the axis of the sprinkler orifice, with the flow confining surface at an acute angle of 30° or less, either up or down, relative to the axis of the orifice, as determined to be suitable for their intended purpose. Examples of such designs are illustrated in Grinnell Corporation Technical Data Sheet TD536 (dated 09/87) and ASCOA Fire Systems catalog sheet 3.19 (dated 11/89). All depending on the design parameters of the flow confining element, including width, length, shape, vertical height above the axis through the center of the sprinkler orifice, angle relative to the axis of the sprinkler orifice and front-to-back location relative to the apex of the sprinkler frame arms, the flow confining element may actually be used to impart lift to the fluid stream discharged from the sprinkler orifice, thereby allowing an area further from the sprinkler to be protected from fire.

Typical of horizontal-type sprinklers having substantially horizontal flow confining elements is that the majority of the flow confining surface is located downstream (forward) of the surface of the deflector mounting boss at the apex of the sprinkler frame arms, or pins to which a vertical hub portion of the deflector is fixed. However, an exception is the Automatic Sprinkler Corporation of America Model F horizontal sidewall sprinkler, as described in catalog sheet 2.17 (dated 07/81) in which between about 40% to 50% of the flow confining element was forward of the deflector mounting surface.

Also typical of horizontal-type sprinklers having deflectors fabricated from one piece of sheet metal, with substantially horizontal flow confining elements, is that they are comprised of members forming the structural support of the flow confining element, relative to the vertical hub portion of the deflector, which are convoluted or have substantially U-shaped bends, and there are only two such support members with one each being located on opposite sides of the axis through the sprinkler orifice, e.g. as seen in Mears U.S. Pat. No. 4,296,815 and Galaszewski U.S. Pat. No. 4,987,957. Although an exception to use of U-shaped supports for the flow confining element is represented by the Viking Model M Extended Coverage Horizontal Sidewall Sprinkler, as illustrated in Catalog sheet sprinkler 82*a* (dated Mar. 26, 1996), it is noted that this sprinkler only utilizes two primarily vertical support members for the flow confining element. It is also noted that each of the primarily vertical support members is formed with a stiffening rib, ostensibly to strengthen the support members.

It is well known that, in a horizontal-type sprinkler with exposed frame arms and a deflector having a substantially horizontal flow confining element, the deflector fabricated (formed) from one piece of sheet metal with two convoluted or primarily vertical structural support members for the flow confining element located at opposite sides of the sprinkler outlet axis, the flow confining element is limited in its resistance to deformation caused by a vertical downward load applied near its forward tip, which is generally the weakest location of the deflector.

SUMMARY OF THE INVENTION

According to one aspect of the invention, a horizontal-type fire protection sprinkler comprises a body defining an orifice and outlet for flow of fluid from a source, and a deflector disposed generally along an axis of the orifice and positioned for impingement of the flow of fluid from the outlet thereupon. The deflector comprises a generally vertical portion and a generally horizontal flow confining element, a substantial portion of the generally horizontal flow confining element being disposed relatively closer to the orifice than the generally vertical portion.

Preferred embodiments of this aspect of the invention may include one or more of the following additional features. The generally horizontal flow confining element comprises a centrally located major segment disposed, in the installed condition of the horizontal-type fire protection sprinkler, at an acute angle to the horizontal. Preferably, the acute angle to the horizontal is about 45° or less, more preferably the acute angle to the horizontal is between about 10° and 45° , and most preferably the acute angle to the horizontal is about 25°. The generally vertical portion and a generally horizontal flow confining element of the deflector are integrally formed from a single piece of material. The generally horizontal flow confining element is attached to the generally vertical portion by at least two, and preferably three, support members. Preferably, the support members are generally vertical. The generally horizontal flow confining element comprises a centrally located major segment defining a leading edge essentially coincident with uppermost edges of the support members closest to the outlet. The generally vertical portion defines an inside deflector surface opposing flow of fluid from the outlet and the generally horizontal flow confining element has a leading edge downstream located along a downstream extremity disposed generally in a plane with the inside deflector surface of the generally vertical portion of the deflector. Preferably, the leading edge, in the installed condition of the horizontal-type fire protection sprinkler, is located generally above the axis of the orifice. More preferably, the leading edge, in the installed condition of the horizontal-type fire protection sprinkler, is located between about 0.25 inch and 0.55 inch, and most preferably about 0.35 inch, above the axis of the orifice.

According to another aspect of the invention, a horizontal-type fire protection sprinkler comprises a body defining an orifice and outlet for flow of fluid from a source, and a deflector disposed generally along an axis of the orifice and positioned for impingement of the flow of fluid from the outlet thereupon. The deflector comprises a generally vertical portion, and a generally horizontal flow confining element attached to the generally vertical portion by at least three support members having inside surfaces opposing flow of fluid from the outlet.

Preferred embodiments of this aspect of the invention may include one or more of the following additional features. The generally horizontal flow confining element is attached to the generally vertical portion by three support members. Preferably, the support members are generally vertical. The generally horizontal flow confining element comprises a centrally located major segment defining a leading edge located along a downstream extremity and essentially coincident with uppermost edges of the inside surfaces of the support members. Preferably, the leading edge, in the installed condition of the horizontal-type fire protection sprinkler, is located generally above the axis of the orifice. More preferably, the leading edge, in the installed condition of the horizontal-type fire protection sprinkler, is located between about 0.25 inch and 0.55 inch, and most preferably about 0.35 inch, above the axis of the orifice.

Preferred embodiments of both aspects of the invention may include one or more of the following additional features. The horizontal-type fire protection sprinkler may have a K-factor of at least 3.5, or at least 5.0, or at least 7.0, or at least 10.5, or at least 13.0.

One objective of the invention is to provide a new deflector for horizontal-type sprinklers with exposed frame arms and a deflector having a substantially horizontal flow confining element, the sprinkler equipped with the new deflector meeting the evaluation requirements of the LPCB, including their deflector strength specifications, as well as the evaluation requirements of UL and FM, without a substantial increase in manufacturing cost over that required for obtaining listing by UL and FM only.

Another objective of the invention is to improve the appearance of horizontal-type sprinklers with exposed frame arms and a deflector having a substantially horizontal flow confining element, the improvement being achieved at little or no increase in manufacturing cost over that for conventional technology deflectors, e.g. as described above.

The flow "Q" from a sprinkler expressed in U.S. gallons per minute (gpm) is determined by the formula:

$$Q=K\ (p)^{1/2}$$

Where "K" represents the nominal sprinkler discharge coefficient, normally referred to as "K-factor" , and "p" represents the residual (flowing) pressure at the inlet to the sprinkler in pounds per square inch (psi). The sprinkler of this invention is a horizontal-type with a so-called "standard orifice" having a nominal K-factor of 5.6 and, a nominal orifice diameter of 0.44 inch. However, the concept could be applied to horizontal-type sprinklers having other, i.e. smaller or larger, values for K-factor.

The horizontal-type sprinkler of this invention is frequently referred to as being of the "standard coverage" variety. That is, the area to be protected by the sprinkler, and the minimum flow rate of fluid to be discharged by the sprinkler, as well as allowable locations and distances between sprinklers, are specifically prescribed in installation standards such as the NFPA 13 previously mentioned. However, the concept of this invention can be applied to horizontal-type sprinklers specially listed for other protection areas, minimum flow rates, and/or locations and distances between sprinklers when found suitable for such use by a listing organization acceptable to the authority having jurisdiction.

Other features and advantages of the invention will be apparent from the following description of a presently preferred embodiment, and from the claims.

Description of the Preferred Embodiments

Figure 2:
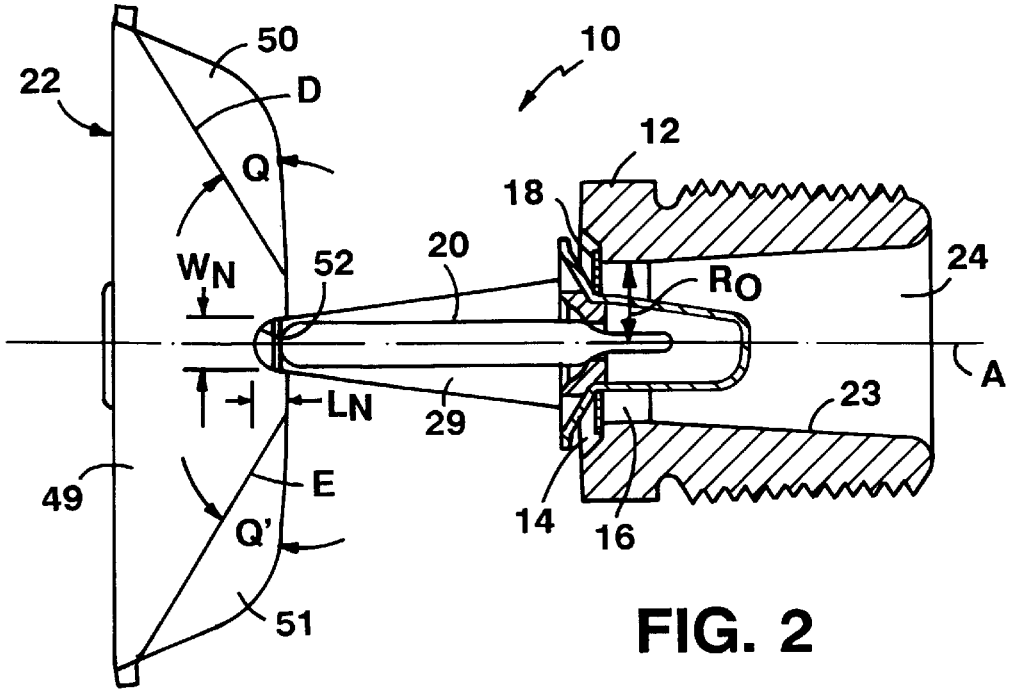
FIG. 2 is a top view of the horizontal-type sprinkler, with the deflector of the invention, taken as a partial section along the line 1—1 of FIG. 1.
Figure 1:
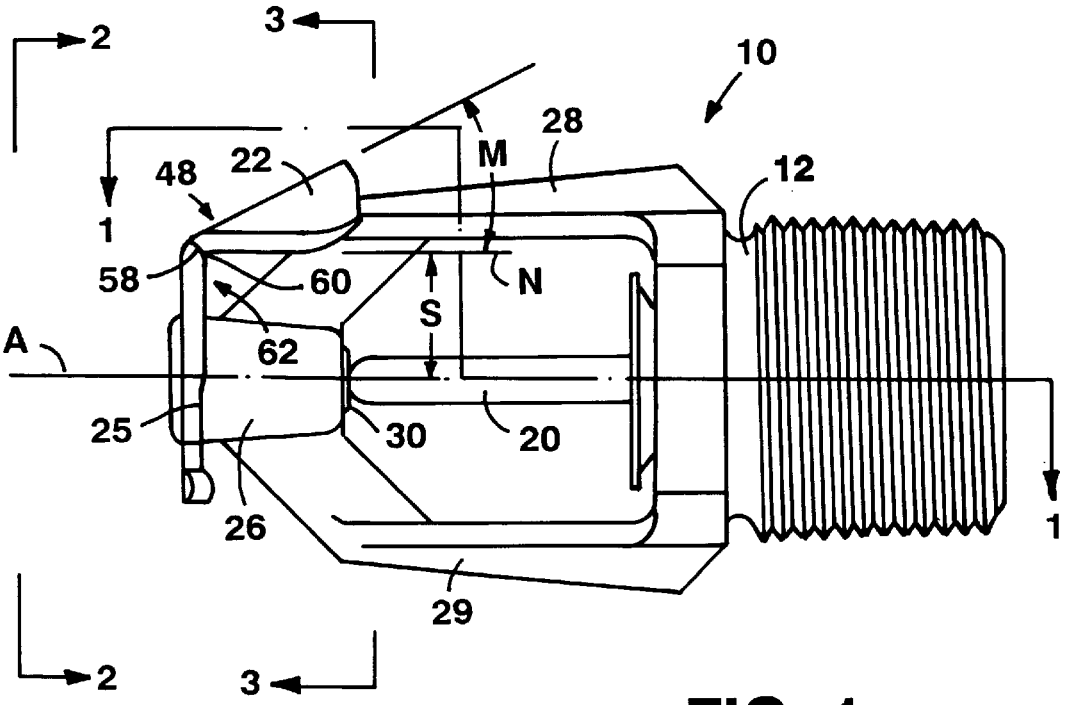
FIG. 1 is a side view of a horizontal-type sprinkler with a deflector of the invention.

Referring to FIGS. 1 and 2, a fire protection sprinkler device 10 of the horizontal-type has a body 12 with an outlet 14 and an orifice 16; a releasable cap 18 normally closing the outlet and securing it in sealed condition; a thermally sensitive element 20 normally retaining the cap 18 in the closed position; and a water distribution deflector 22. The size of the orifice 16, which is normally located just upstream of the outlet 14, in combination with the contour of the waterway transition surface 23 between the inlet 24 and the orifice 16, determines the K-factor of the sprinkler.

The nominal diameter of the orifice 16 of the described sprinkler of the invention is 0.44 inch, and the nominal K-factor is 5.6.

Figure 4:
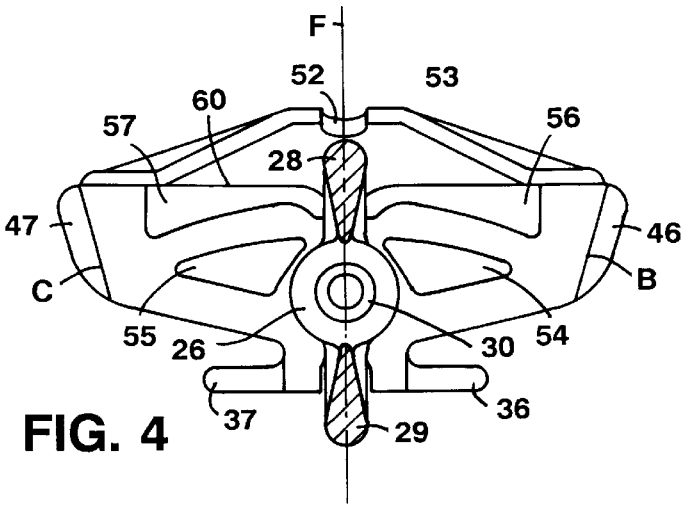
FIG. 4 is a rear view of the deflector of the invention taken through a section of the frame arms of the sprinkler along the line 3—3 of FIG. 1.

A horizontal-type sprinkler 10 is typically installed so that, following release of the thermally sensitive element 20, the fluid stream discharged from the outlet 14 is initially directed horizontally against the opposed surfaces of the deflector 22. The deflector is typically fixed to a deflector mounting surface 25 of deflector mounting boss 26, which in turn is supported by frame arms 28, 29 attached in a generally U-shaped configuration to the body 12. The axis, A, through the center of the orifice 16, is coincident with the axis through the center of the deflector mounting boss 26, and also lies in the plane, F, generally through the center of frame arms 28, 29, as shown in FIG. 4. A compression screw 30 threaded internally within the deflector mounting boss 26 is used to normally secure the thermally sensitive element 20, along with cap 18, in the closed position.

Figure 3:
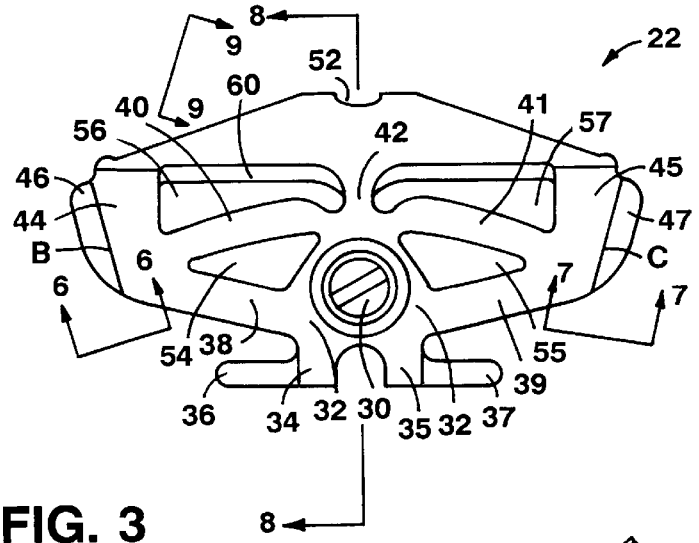
FIG. 3 is a front view of the deflector of the invention taken along the line 2—2 of FIG. 1.

Turning now to FIG. 3, deflector 22 (shown in frontal view) is fabricated and formed as one piece from brass material having a nominal thickness of 0.051 inch. Extending from the hub portion 32 are a plurality of deflector elements 34, 35, 36, 37, 38, 39, 40, and 41 of different sizes and shapes, configured to contribute to the desired break-up of the fluid stream over an area to be protected, as will now be described.

Figure 5:
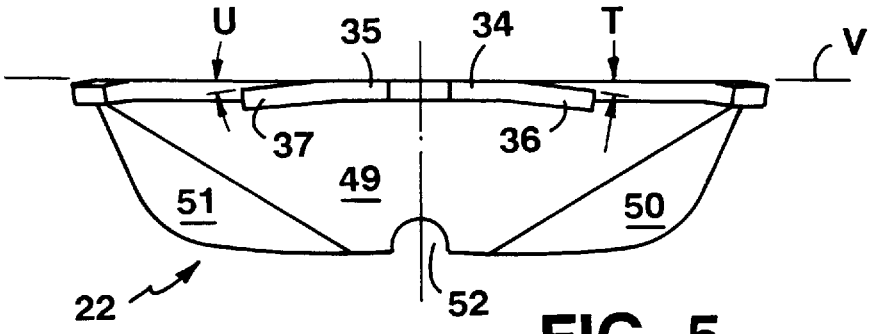
FIG. 5 is a bottom view of the deflector of FIG. 3.

Referring also to FIG. 5, tines 36 and 37 are bent backwards at angles, T and U, respectively, e.g. 5° to 8°, from the plane, V, of the generally vertical hub portion 32 of the deflector 22.

Figure 7:
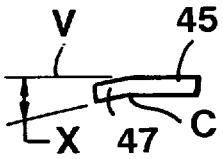
FIGS. 6 and 7 are top views of the deflector of the invention taken along the lines 6—6 and 7—7, respectively, of FIG. 3.
Figure 6:
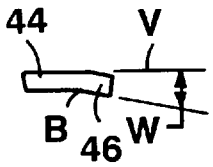

Also extending from the hub portion 32 of the deflector 22, as shown in FIG. 3, is a central, generally vertical support member 42, formed substantially within the same plane, V, as the generally vertical hub portion 32. Interconnecting the outside of deflector elements 38, 40 is an outside, generally vertical support member 44. The outside deflector elements 39, 41 are similarly interconnected by outside, generally vertical support member 45. Both outside, generally vertical support members 44, 45 are formed substantially within the same plane, V, as generally vertical hub portion 32. Referring to FIGS. 6 and 7, tine 46 is bent backwards from the outermost edge of generally vertical support member 44 at an angle, W, e.g. 7° to 8° , and, similarly, tine 47 is bent backwards from the outermost edge of generally vertical support member 45, at an angle, X, e.g. also 7° to 8°. The line of bend, B, for tine 46 is sloped 15° inwardly from vertical, i.e. relative to the plane, F, of the frame arms, towards the center of the deflector, and the line of bend, C, for tine 47 is symmetrically sloped 15° inwardly from vertical, i.e., again, relative to the plane, F, of the frame arms, towards the center of the deflector.

Figure 8:
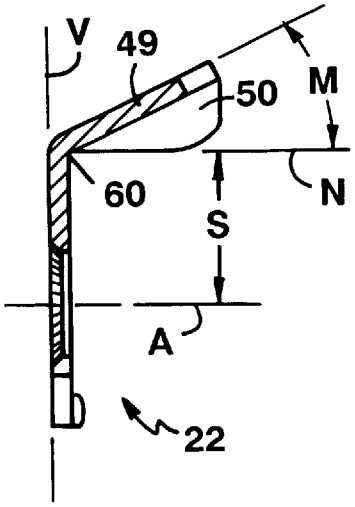
FIG. 8 is a side section view of the deflector of the invention taken along the line 8—8 of FIG. 3.
Figure 9:
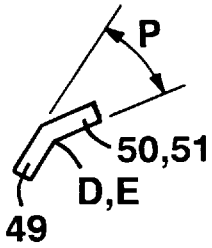
FIG. 9 is a view of the deflector of the invention taken along the line 9—9 of FIG. 3.

Referring to FIGS. 3 and 4, members 42, 44, 45 support the substantially horizontal flow confining portion 48 (shown in FIG. 1) formed by the three planar segments designated as 49, 50, 51 (FIG. 2). The width of the central generally vertical support member 42 is about 0.09 inch at its narrowest point, gradually increasing to a width of about 0.27 inch at the point where it forms into and supports major segment 49. Each of the outside vertical support members 44, 45 has a width of about 0.20 inch where it forms into and supports major segment 49. Major segment 49, which is about 1.70 inches wide and 0.45 inch deep, is formed upwards at an acute angle, M (FIG. 8), e.g. about 25°, from a horizontal plane, N, perpendicular to the vertical plane, V, of the hub portion 32, while each of the minor segments 50 and 51 (re formed downward at an angle, P (FIG. 9), e.g. about 34.5° to the surface of major segment 49 along lines of bends, D, E, respectively. The line of bend, D, for minor segment 50 is oriented at an acute angle, Q (FIG. 2), e.g. of 33.8° , to the rearmost edge of segment 50, while the line of bend, E, for minor segment 51 is similarly orientated, i.e. at an acute angle Q', e.g. of 33.8°, relative to the rearmost edge of segment 51, measured with the deflector in a flat state prior to forming. Located at the central rear portion of major segment 49 is a U-shaped notch 52 having a width, $W_N$ (FIG. 2), e.g. about 0.14 inch, and a length, $L_N$ (FIG. 2), e.g. about 0.10 inch, which ensures against interference between inside surface 53 of major segment 49 and the outside edge of frame arm 28, when the deflector 22 is fixed to mounting boss 26, as shown. Apertures 54 and 55 are formed between the hub portion 32, elements 38, 40 and outside generally vertical support member 44, and between the hub portion 32, elements 39, 41 and outside generally vertical support member 45, respectively. Apertures 56, 57 are similarly formed between deflector element 40 and generally vertical support members 42, 44 and between deflector element 41 and generally vertical support members 42, 45, respectively. As may be seen in FIGS. 2, 3 and 4, all elements of the water distribution deflector 22 are symmetrical left-to-right about the plane, F, generally through the center of frame arms 28, 29.

The intersection 58 (FIG. 1) between segment 49 of substantially horizontal flow confining element 48 and generally vertical support members 42, 44, 45 lies along an inner (towards outlet) leading edge 60 generally perpendicular to the plane, F, generally through the center of frame arms 28, 29. The leading edge 60 is located at a predetermined distance, S, e.g. about 0.35 inch, above the axis, A, through the center of the deflector mounting boss 26 and orifice 16 of the sprinkler. The height, S, of the leading edge 60 above the axis, A, compared to the radius, $R_o$, of the orifice, i.e. about 0.22 inch, places the leading edge 60 above (outside) of the generally cylindrical stream of fluid discharged from the outlet 14 of the sprinkler 10. Nonetheless, the substantially horizontal portion 48 of the deflector acts as a flow confining element to restrict the upward flow portion of the fluid stream striking the inside generally vertical face 62 of deflector 22, as well as deflector mounting boss 26, frame arms 28, 29 and compression screw 30. As a result of this restriction of upward movement of the water stream, the upper portion of the spray pattern discharged by the sprinkler 10 is defined by the leading edge 60. In addition, the size, shape, and orientation of major segment 49, in combination with the size, shape, and orientation of each of the minor segments 50, 51, provide the desired shape of the rearward spray pattern of sprinkler 10.

Figure 10:
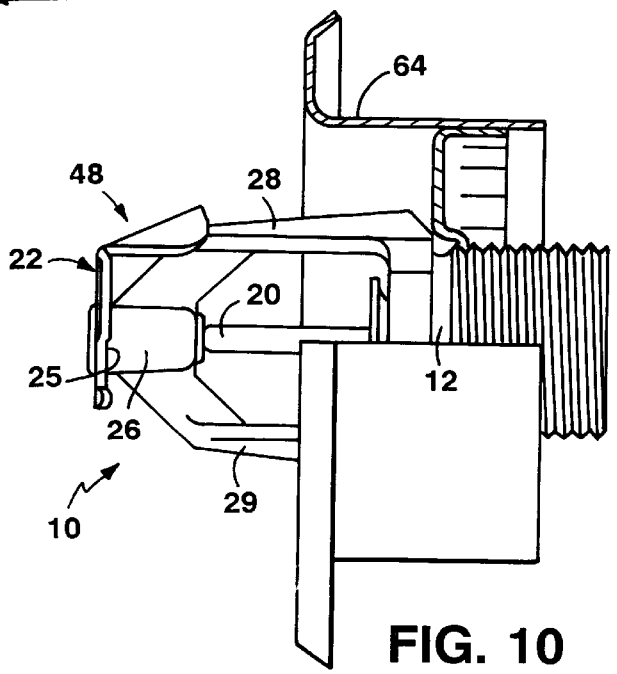
FIG. 10 is a side view of a horizontal-type sprinkler, with a deflector of the invention, mounted inside of a recessed escutcheon.

In the deflector of the invention, the substantially horizontal flow confining element 48 is substantially rearward of deflector mounting surface 25 of deflector mounting boss 26. As a result, the over-all length of the horizontal-type sprinkler 10 is reduced, and it becomes less obtrusive, especially when mounted inside of a recessed escutcheon 64, as shown in FIG. 10. The over-all appearance of the horizontal-type sprinkler is thereby improved, at little or no increase in manufacturing cost, over the appearance of conventional technology horizontal-type sprinkler deflectors.

Also, the use of three vertical support members 42, 44, 45 joining the substantially horizontal flow confining element 48 of deflector 22 provided sufficient additional strength to enable the sprinkler 10 to pass the LPCB deflector strength requirement without a penalty of cost as compared to sprinkler designs meeting UL and FM evaluation requirements. As a result, the sprinkler design of the invention is applicable for both U.S. national and international markets.

In addition to the dimension provided above, in the preferred embodiment of a deflector of the invention for a horizontal-type fire protection sprinkler, a blank from which the deflector 22 is formed is about 1.12 inches high and about 1.83 inches wide. Deflector portions 34, 35 are about 0.12 inch wide. Tines 36, 37 are about 0.08 inch high and 0.27 inch wide. Deflector elements 38, 39 are about 0.14 inch wide. Deflector elements 40, 41 are about 0.12 inch wide over the major portion of their length, narrowing to a minimum width of about 0.09 inch in the region of the hub portion 32. Tines 46, 47 have a maximum width of about 0.06 inch.

Other embodiments of the invention are within the scope of the following claims.

What is claimed is:

1. A horizontal-type fire protection sprinkler comprising a body defining an orifice having a generally horizontal axis and an outlet for flow of fluid from a source, and a deflector disposed in intersection with said generally horizontal axis of said orifice and positioned for impingement of the flow of fluid from said outlet thereupon, said deflector comprising a generally vertical portion and a generally horizontal flow confining element, a substantial portion of said generally horizontal flow confining element being disposed relatively closer to said orifice than said generally vertical portion.

2. The horizontal-type fire protection sprinkler of claim 1, wherein said generally horizontal flow confining element comprises a centrally located major segment disposed, in the installed condition of said horizontal-type fire protection sprinkler, at an acute angle to the horizontal.

3. The horizontal-type fire protection sprinkler of claim 2, wherein said acute angle to the horizontal is about 45° or less.

4. The horizontal-type fire protection sprinkler of claim 3, wherein said acute angle to the horizontal is between about 10° and 45°.

5. The horizontal-type fire protection sprinkler of claim 4, wherein said acute angle to the horizontal is about 25°.

6. The horizontal-type fire protection sprinkler of claim 1, wherein said generally vertical portion and a generally horizontal flow confining element of said deflector are integrally formed from a single piece of material.

7. The horizontal-type fire protection sprinkler of claim 1, wherein said generally horizontal flow confining element is attached to said generally vertical portion by at least two support members.

8. The horizontal-type fire protection sprinkler of claim 7, wherein said support members are generally vertical.

9. The horizontal-type fire protection sprinkler of claim 7, wherein said generally horizontal flow confining element is attached to said generally vertical portion by three support members.

10. The horizontal-type fire protection sprinkler of claim 9, wherein said support members are generally vertical.

11. The horizontal-type fire protection sprinkler of claim 7, 8, 9 or 10, wherein said generally horizontal flow confining element comprises a centrally located major segment defining a leading edge essentially coincident with uppermost edges of said support members closest to said outlet.

12. The horizontal-type fire protection sprinkler of claim 1 or 7, wherein said generally vertical portion defines an inside deflector surface opposing flow of fluid from said outlet and said generally horizontal flow confining element has a leading edge downstream located along a downstream extremity disposed generally in a plane with said inside deflector surface of said generally vertical portion of said deflector.

13. The horizontal-type fire protection sprinkler of claim 12, wherein said leading edge, in the installed condition of said horizontal-type fire protection sprinkler, is located generally above said axis of said orifice.

14. The horizontal-type fire protection sprinkler of claim 13, wherein said leading edge, in the installed condition of said horizontal-type fire protection sprinkler, is located between about 0.25 inch and 0.55 inch above said axis of said orifice.

15. The horizontal-type fire protection sprinkler of claim 14, wherein said leading edge, in the installed condition of said horizontal-type fire protection sprinkler, is located about 0.35 inch above said axis of said orifice.

16. A horizontal-type fire protection sprinkler comprising a body defining an orifice having a generally horizontal axis and an outlet for flow of fluid from a source, and a deflector disposed in intersection with said generally horizontal axis of said orifice and positioned for impingement of the flow of fluid from said outlet thereupon, said deflector comprising a generally vertical portion and a generally horizontal flow confining element attached to said generally vertical portion by at least three support members having inside surfaces opposing flow of fluid from said outlet.

17. The horizontal-type fire protection sprinkler of claim 16, wherein said support members are generally vertical.

18. The horizontal-type fire protection sprinkler of claim 16, wherein said generally horizontal flow confining element is attached to said generally vertical portion by three support members.

19. The horizontal-type fire protection sprinkler of claim 18, wherein said support members are generally vertical.

20. The horizontal-type fire protection sprinkler of claim 16, 17, 18 or 19, wherein said generally horizontal flow confining element comprises a centrally located major segment defining a leading edge located along a downstream extremity and essentially coincident with uppermost edges of said inside surfaces of said support members.

21. The horizontal-type fire protection sprinkler of claim 20, wherein said leading edge, in the installed condition of said horizontal-type fire protection sprinkler, is located generally above said axis of said orifice.

22. The horizontal-type fire protection sprinkler of claim 21, wherein said leading edge, in the installed condition of said horizontal-type fire protection sprinkler, is located between about 0.25 inch and 0.55 inch above said axis of said orifice.

23. The horizontal-type fire protection sprinkler of claim 22, wherein said leading edge, in the installed condition of said horizontal-type fire protection sprinkler, is located about 0.35 inch above said axis of said orifice.

24. The horizontal-type fire protection sprinkler of claim 1 or 16, wherein said sprinkler has a K-factor of at least 3.5.

25. The horizontal-type fire protection sprinkler of claim 1 or 16, wherein said sprinkler has a K-factor of at least 5.0.

26. The horizontal-type fire protection sprinkler of claim 1 or 16, wherein said sprinkler has a K-factor of at least 7.0.

27. The horizontal-type fire protection sprinkler of claim 1 or 16, wherein said sprinkler has a K-factor of at least 10.5.

28. The horizontal-type fire protection sprinkler of claim 1 or 16, wherein said sprinkler has a K-factor of at least 13.0.

* * * * *